US006119990A

United States Patent [19]

Kump et al.

[11] Patent Number: 6,119,990

[45] Date of Patent: Sep. 19, 2000

[54] HOLDER FOR ELECTRONIC INFORMATION CARRIER

[75] Inventors: Daniel J. Kump, Gates Mills; Stephen D. Wamsley, Lakewood; James A. Bacnik, Mentor, all of Ohio

[73] Assignee: Fasteners For Retail, Inc., Cleveland, Ohio

[21] Appl. No.: 08/880,079

[22] Filed: Jun. 20, 1997

Related U.S. Application Data

[60] Provisional application No. 60/020,212, Jun. 21, 1996.

[51] Int. Cl.[7] ..... G09F 3/18

[52] U.S. Cl. ..... 248/220.22; 248/288.31; 248/292.14; 248/225.11; 248/923; 40/661.03; 211/57.1; 211/59.1; 211/86.01

[58] Field of Search ..... 248/220.22, 288.31, 248/291.1, 292.14, 288.51, 225.11, 444.1, 452, 447.1, 454, 479, 923, 922; 40/661.03, 642.01, 642.02, 649, 658, 650; 362/287, 285, 269, 418, 427, 429; 211/57.1, 59.1, 86.01

[56] References Cited

U.S. PATENT DOCUMENTS

| | | | |
|---|---|---|---|
| 2,608,776 | 9/1952 | Schuler | 40/650 |
| 2,895,241 | 7/1959 | Ferdinand et al. | 40/650 |
| 3,337,977 | 8/1967 | Sobesky | 40/651 X |
| 3,889,408 | 6/1975 | Offner | 40/661.03 |
| 3,953,933 | 5/1976 | Goldstein | 40/642.02 |
| 4,334,372 | 6/1982 | Colmar | 40/650 |
| 4,470,571 | 9/1984 | Hartman | 248/452 |
| 4,886,231 | 12/1989 | Doerksen | 248/455 |
| 5,044,104 | 9/1991 | Hopperdietzel . | |
| 5,289,652 | 3/1994 | Kringel et al. | 40/651 |
| 5,375,357 | 12/1994 | Butcher et al. | 248/220.21 X |
| 5,408,775 | 4/1995 | Abramson et al. | 40/650 X |
| 5,518,216 | 5/1996 | Wu | 248/923 X |
| 5,553,412 | 9/1996 | Briechle et al. . | |
| 5,575,100 | 11/1996 | Marvin et al. | 40/642.02 |
| 5,611,512 | 3/1997 | Cholet . | |
| 5,715,622 | 2/1998 | Giordano, Jr. | 40/661.03 |
| 5,791,080 | 8/1998 | Hamano | 40/642.02 |
| 5,816,550 | 10/1998 | Watanabe et al. | 248/222.11 |

FOREIGN PATENT DOCUMENTS

| | | |
|---|---|---|
| 0 377 772 A1 | 2/1989 | European Pat. Off. . |
| WO 93/19448 | 9/1993 | WIPO . |

OTHER PUBLICATIONS

1996 Buyers Guide of Fasteners For Retail (pp. 24, 32–35, 38, 72 and 77).

1997 Buyers Guide of Fasteners For Retail entitled Our Experience is On Display (pp. 22, 23, 32, 35–38, 68 and 73).

HL Display 1995 Catalog—Cover page and pp. 36–41.

*Primary Examiner*—Leslie A. Braun
*Assistant Examiner*—Stephen S. Wentsler
*Attorney, Agent, or Firm*—Fay, Sharpe, Fagan, Minnich & McKee, LLP

[57] ABSTRACT

A holder for an electronic information carrier includes a body having a cavity for holding an associated electronic price label, a rear wall having a convex section and an aperture extending through the convex section. An adapter cooperates with the body. The adapter has a front wall with a concave section in which the rear wall convex section of the body can be accommodated. An aperture extends through the concave section. The adapter aperture is aligned with the body rear wall convex section aperture. A fastener selectively extends through the aligned aperture to secure the holder to the adapter and orient the body at a first angle to a horizontal plane.

13 Claims, 15 Drawing Sheets

HOLDER FOR ELECTRONIC INFORMATION CARRIER

This application bases its priority on provisional application Ser. No. 60/020,212 filed on Jun. 21, 1996.

BACKGROUND OF THE INVENTION

The present invention relates to holders for information carriers used in a retail environment. Such carriers are employed on the front faces of shelves in retail stores to describe the nature of goods displayed, the price of the goods, article numbers and the like. More particularly, the present invention relates to a holder for an electronic information carrier.

The retail trade has now begun to employ electronic information carriers for displaying the price of goods which are offered for sale and also a variety of other information concerning such goods. Such electronic information carriers include an LCD type unit and are advantageous from the standpoint that the information displayed by the carrier can be changed remotely, such as by infra-red controllers, radio controllers or hard wiring. The letters and digits on the display are clear and distinct and can be readily discerned if the potential purchaser is standing directly in front of the display. However, the display can be difficult to read when the surface of the display defines an acute angle with the line of vision of the viewer.

It is known from conventional information displays, which provide labels and prices that needed to be manually changed, that when the holders are mounted on the front edge of a low shelf or a high shelf, then the display has to be tilted in order to allow the potential purchaser to clearly see the display. To this end, conventional information displays mounted on the front edge of a shelf have been produced in a two piece design so that a forward part could be mounted at different angles in relation to a mounting part.

It is also known that single piece holders can be employed for this purpose. Such holders have been designed for both conventional information displays as well as electronic information carriers. One known single piece holder or channel which can be used in connection with electronic information display carriers has a mounting part and an information carrier receiving part. One of these is provided with a support leg which is pivotally connected to one part and the other part is provided with at least two support elements which are located at different heights. The support elements are intended to receive the free end part of the support leg. This construction enables the viewing angle to be adjusted without needing to separate the mounting part from the holder part.

However, this known holder for electronic information carriers is disadvantageous from the standpoint that it requires a complex extrusion to manufacture the holder. Since the extrusion is complex in shape, it is also expensive and requires a significant amount of plastic material.

Accordingly, it has been considered desirable to develop a new and improved holder for electronic information carriers which would overcome the foregoing difficulties and others while providing better and more advantageous overall results.

BRIEF SUMMARY OF THE INVENTION

In accordance with the present invention, a new and improved holder is provided for an electronic information carrier.

More particularly in accordance with this aspect of the invention, the holder comprises a mounting part which is intended to be mounted on the front edge, or adjacent the front edge, of a shelf, a wire basket or the like merchandise carrying fixture. A second part is secured to the first part. The second part includes a substantially rectangular frame with a front wall which can be pivoted away from an adjacent wall so as to open the carrier and allow the information holder to be mounted therein. The second part can be mounted at different angles in relation to the first part to adjust the viewing angle at which the electronic information carrier is viewed.

One advantage of the present invention is the provision of a new and improved holder for electronic information carriers.

Another advantage of the present invention is the provision of a two part holder for an electronic information carrier.

Still another advantage of the present invention is the provision of a two part holder for an electronic information carrier wherein the first part of the holder can be rotated in relation to the second part of the holder and fixed at one of a variety of positions in order to adjust the viewing angle at which the electronic information carrier is viewed by a potential purchaser.

Yet another advantage of the present invention is the provision of a two part holder for an electronic information carrier including a housing which has a clip on its back face to allow the mounting of advertising to the housing.

A further advantage of the present invention is the provision of a two part holder for an electronic information carrier including a housing having a hinged portion which allows an opening of a front window or lens of the housing so as to allow the electronic information carrier to be mounted in the housing.

A still further advantage of the present invention is the provision of a two part holder for an electronic information carrier including a common housing and a series of adaptors which allow the housing to be mounted to a variety of fixtures. Such adaptors can include, e.g. an angled peghook adaptor, a standard C-channel mount, a freezer tray adaptor, a C-channel adaptor, a wire fixture adaptor, a peghook rail adaptor which can be used either for a peghook plate mount or a spring clip mount, an angled front adaptor, a wire basket adaptor or the like.

A yet further advantage of the present invention is the provision of a holder for an electronic information carrier which is particularly adapted for mounting on a bottom shelf. This holder includes a body having a substantially rectangular cross-section and a mounting leg extending away therefrom.

An additional advantage of the present invention is the provision of a two part holder for an electronic information carrier in which a housing can be mounted on an adaptor at one of a variety of positions in order to adjust the viewing angle at which the electronic information carrier is viewed by the potential purchaser while an upper edge of the housing never extends above the plane of the shelf—so as to interfere with products being removed from the shelf—and while the housing remains immediately adjacent the shelf in all of its variety of positions.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several embodiments of which will be described in detail in the specification and illustrated in the accompanying drawings which form a part hereof and wherein.

DETAILED DESCRIPTION OF THE SEVERAL EMBODIMENTS

Figure 1:
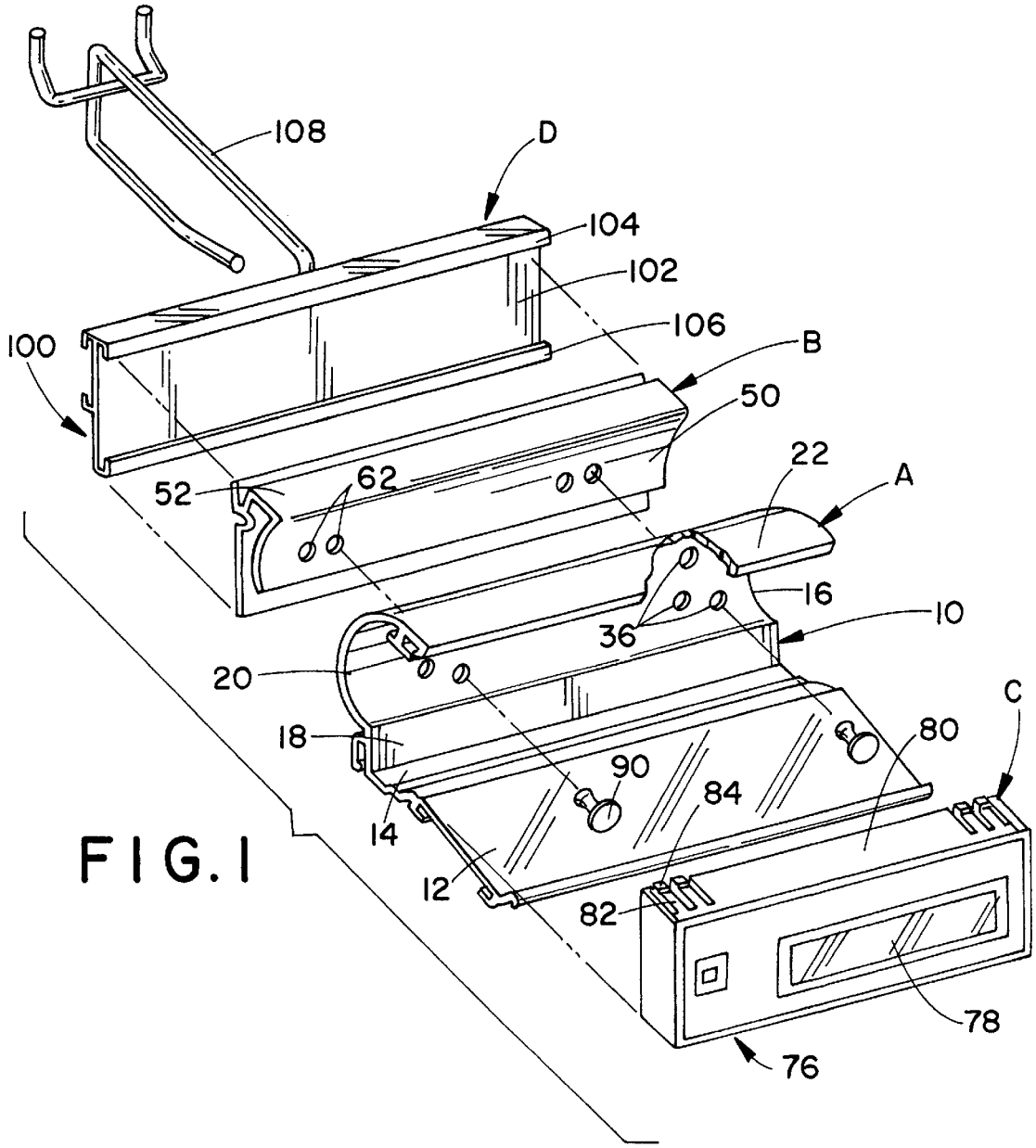
FIG. 1 is an exploded perspective view of a two part holder for an electronic information carrier or price label according to a first embodiment of the present invention.

Referring now to the drawings wherein the showings are for purposes of illustrating several embodiments of the invention only and not for purposes of limiting same, FIG. 1 shows a holder for an electronic information carrier. More specifically, FIG. 1 illustrates a housing A which is secured to an adaptor B and is capable of holding an electronic price label C. The adaptor B is then employed to secure the housing and the electronic price label to a mount D.

The housing comprises a body 10 having a transparent front wall 12, a bottom wall 14 and a back wall 16 having a planar first section 18 and a curved second section 20. The back wall terminates in a top wall 22. As can be seen from FIG. 4, a ticket channel 24 is defined between a lower lip 25 and an upper lip 26 extending from the front wall 12. The front wall 12 is pivotally mounted from the bottom wall 14 by a hinge 30. The bottom wall 14 includes an indented section in which there is positioned a layer 32 of a flexible material.

Preferably, the housing A is manufactured in one piece via co-extrusion from a variety of different plastics. In the preferred embodiment, clear polyvinylchloride (PVC) is employed for the front wall 12. A flexible PVC is employed for the hinge 30 and the layer 32 and a rigid PVC is employed for the bottom wall 14, back wall 16 and top wall 22.

Figure 2:
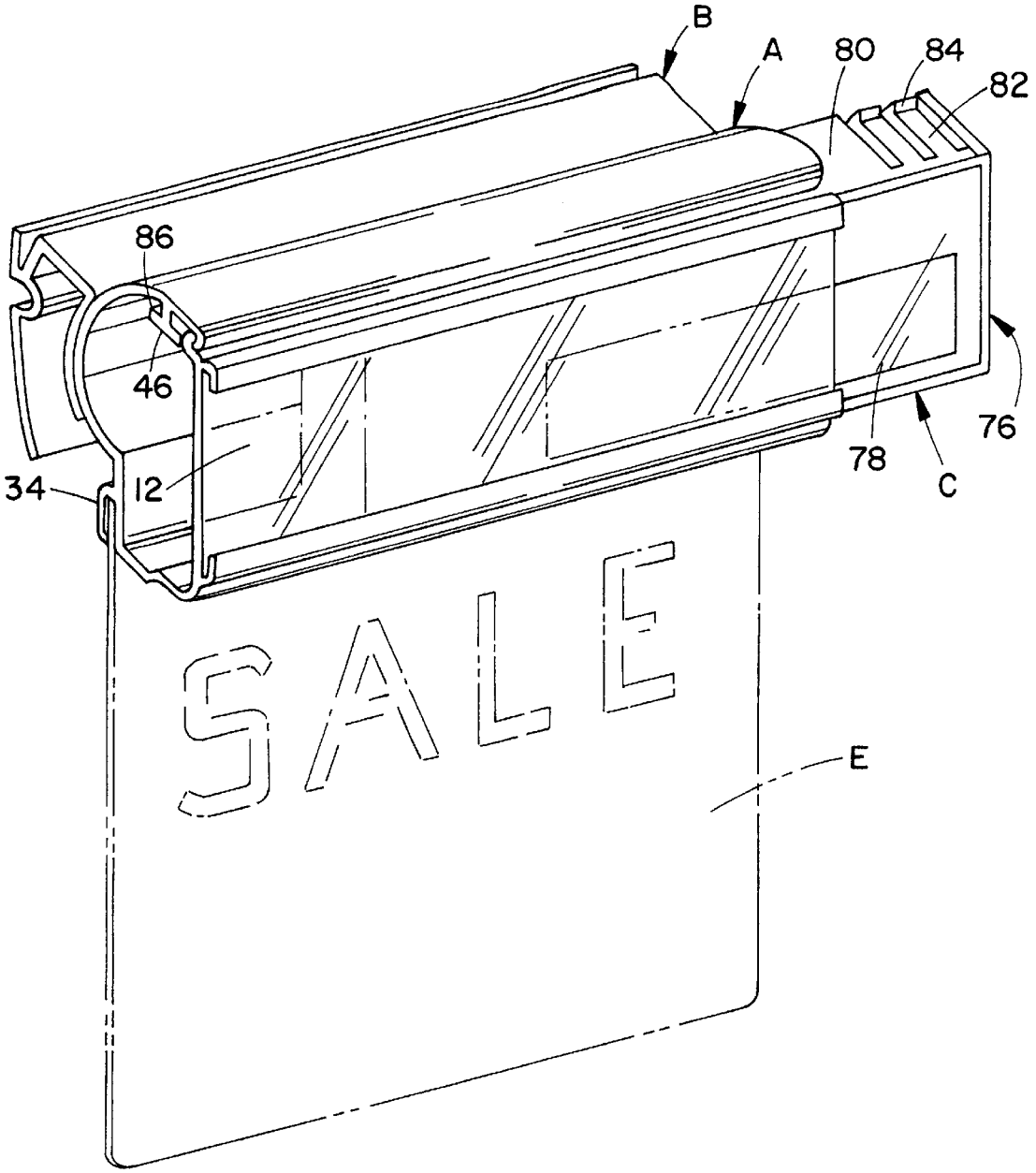
FIG. 2 is a perspective view of the two part holder of FIG. 1 in an assembled form and with a sign which is supported by the holder.
Figure 3:
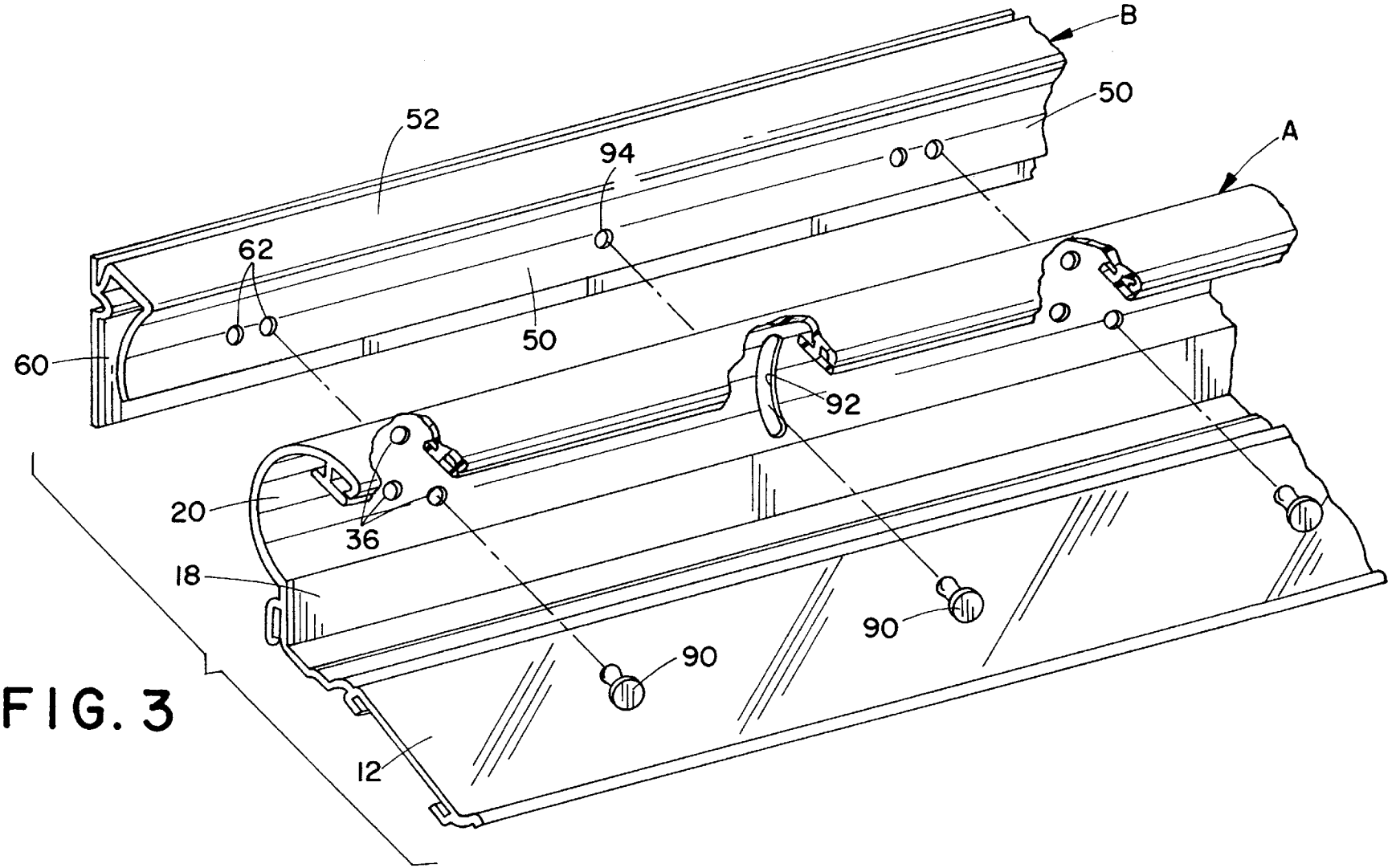
FIG. 3 is an exploded perspective view of a housing and an adaptor of the two part holder of FIG. 1.

There is provided on a rear surface of the back wall first section 18 a holding finger 34. As illustrated in FIG. 2, a suitable conventional sign E can be secured to the housing A by a cooperation of the holding finger 34 with the back wall 16. As best seen in FIG. 3, a plurality of spaced apertures 36 extend through the curved second section 20 of the back wall 16. Two spaced sets of three such apertures are shown.

Figure 4:
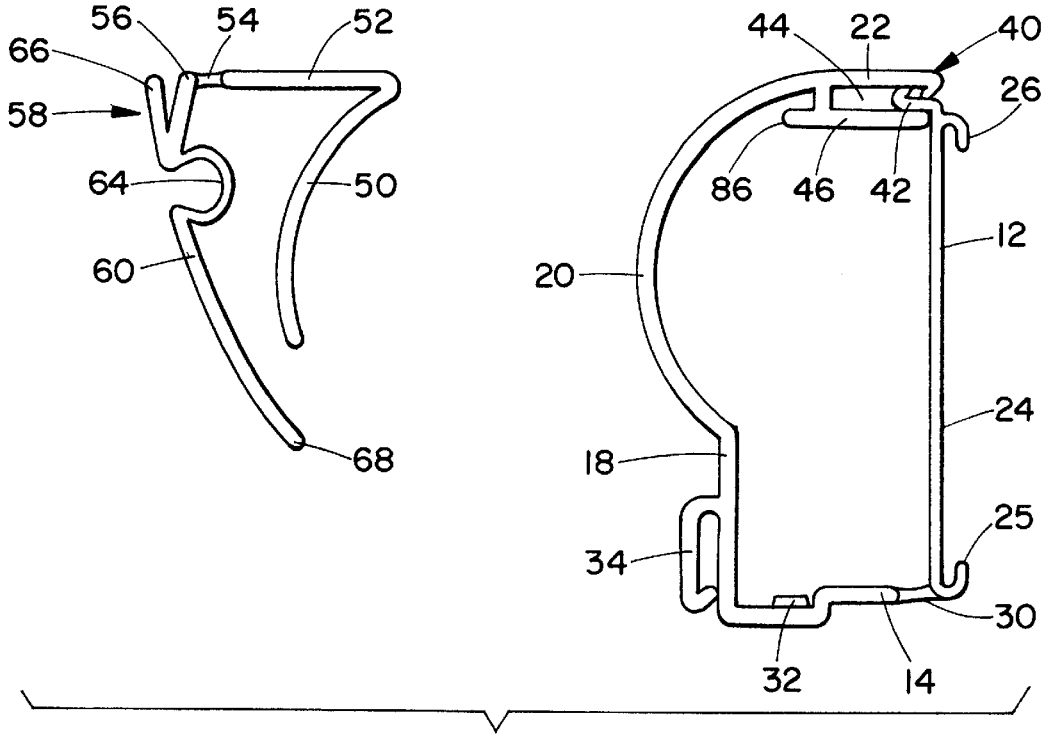
FIG. 4 is an enlarged exploded side elevational view of the housing and the adaptor of the holder of FIG. 3.

As is evident from a review of FIGS. 1 and 4, the front wall 12 can pivot from an open position to a closed position in relation to the top wall 22. There is provided a locking means 40 which can secure the front wall to the top wall. The locking means comprises a finger 42 which extends rearwardly from a top edge of the front wall 12. The finger engages in a slot 44 defined between the top wall and a flange 46 extending downwardly therefrom. Because the housing is made from a resilient plastic material, the finger 42 can engage in the slot 44 and disengage therefrom with relative ease.

With reference again to FIG. 1, the adaptor B comprises a curved front wall 50 and a planar top wall 52. As best illustrated in FIG. 4, a hinge 54 connects the top wall 52 to a first fork 56 of a forked upper end 58 of a back wall 60. As shown in FIG. 3, a pair of spaced apertures 62 is provided on the front wall 50. Two sets of such apertures 62 are provided, each being aligned with one of the sets of apertures 36. With reference again to FIG. 4, a curved section 64 is disposed between a top end 66 and a bottom end 68 of the back wall 60.

Preferably the adaptor B is also manufactured in one piece via co-extrusion from a suitable plastic material such as PVC. A flexible PVC is employed for the hinge 54 and rigid PVC, in different thicknesses, can be employed for the several walls of the adaptor. More specifically, the front and top walls 50 and 52 are somewhat thicker than is the back wall 60. In addition, the first fork 56 is somewhat thicker than is the second fork.

Adapted to be disposed in the housing A is an electronic price label C. The price label includes a casing 76 with a front wall which has an LCD display 78. With reference now to FIG. 2, a top wall 80 of the housing 76 includes at least one arm 82 which has a protruding finger 84. The finger is cooperable with and accommodated behind an end 86 of the flange 46 depending from the top wall 22 of the housing body 10.

With reference now to FIG. 3, a plurality of fasteners 90 is employed to secure the housing A to the adaptor B. More specifically, a fastener 90, which can be a conventional dart clip or the like, extends through one of the apertures 36 in the housing back wall second section 20 and an aligned one of the apertures 62 in the front wall 50 of the adaptor B. Depending on which of the apertures 36 and 62 are chosen, the housing A can be oriented in relation to the adaptor B. This is illustrated in FIGS. 8A–8C and 11A–11C.

Spaced from the plurality of apertures 36 is a transversely extending slot 92 (FIG. 3) located in the back wall second section 20. The slot 92 is aligned with an aperture 94 located in the adaptor front wall 50. A suitable fastener 90 extends through the slot 92 and into the aperture 94 to further secure the housing A to the adaptor B. Once the fastener 90 has connected the housing A to the adaptor B, then the housing can be pivoted in relation to the adaptor so as to align one of the housing apertures 36 with one of the adaptor apertures 62. When this is accomplished, the fastener 90 can be secured therein.

It should be appreciated from FIG. 3 that the housing A can be long enough to accommodate several electronic price labels 76 in a spaced manner from each other as would be desirable along a length of a store shelf.

With reference now again to FIG. 1, the adaptor B can be secured to a plate 100 of a mount D. The plate, which can be made of a suitable conventional thermoplastic, includes a front wall 102 having an upper lip 104 and a lower lip 106 extending therefrom. The top and bottom ends 66 and 68 of the adaptor back wall 60 are meant to fit in the lips of the mount front wall 102. In order to slide the adaptor back wall behind the lips of the mount front wall, the top and bottom end 66 and 68 of the adaptor back wall 60 can be brought closer to each other manually via a flexing of the back wall at its curved section 64. Once the manual pressure on the two ends of the back wall 60 is released, the natural resilience of the back wall will force the top and bottom ends into contact with the pair of lips. A hook 108 is suitably secured by conventional means to a back side of the plate 100. The hook 108 can be a conventional pegboard type hook.

Figure 5:
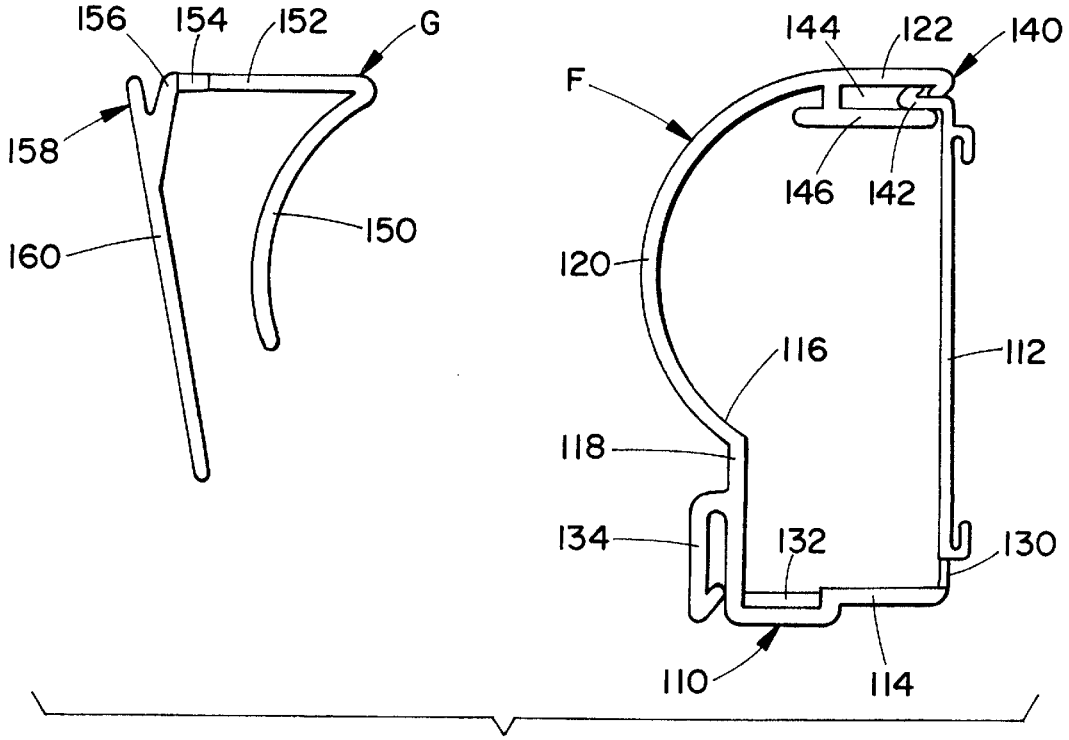
FIG. 5 is an exploded side elevational view of a housing and another style of adaptor according to another embodiment of the present invention.

With reference now to FIG. 5, another housing F and adaptor G are there illustrated. The housing F comprises a body 110 with a front wall 112, a bottom wall 114, a back wall 116 having first and second sections 118 and 120 and a top wall 122. A hinge 130 is employed to pivotally mount the front wall 112 from the bottom wall 114. Also, a layer of a flexible material 132 is disposed in an indented section of the bottom wall 114. A holding finger 134 is located on a back side of the back wall first section 118. A locking means 140 is employed to secure the top end of the front wall 112 to the top wall 122 when so desired. To this end, a finger 142 of the front wall 112 protrudes into a slot 144 defined between the top wall 122 and a flange 146 depending therefrom.

The adaptor G comprises a curved front wall 150, a planar top wall 152 and a hinge 154 which connects these two elements to a first fork member 156 of a forked upper end 158 of a back wall 160.

Figure 6:
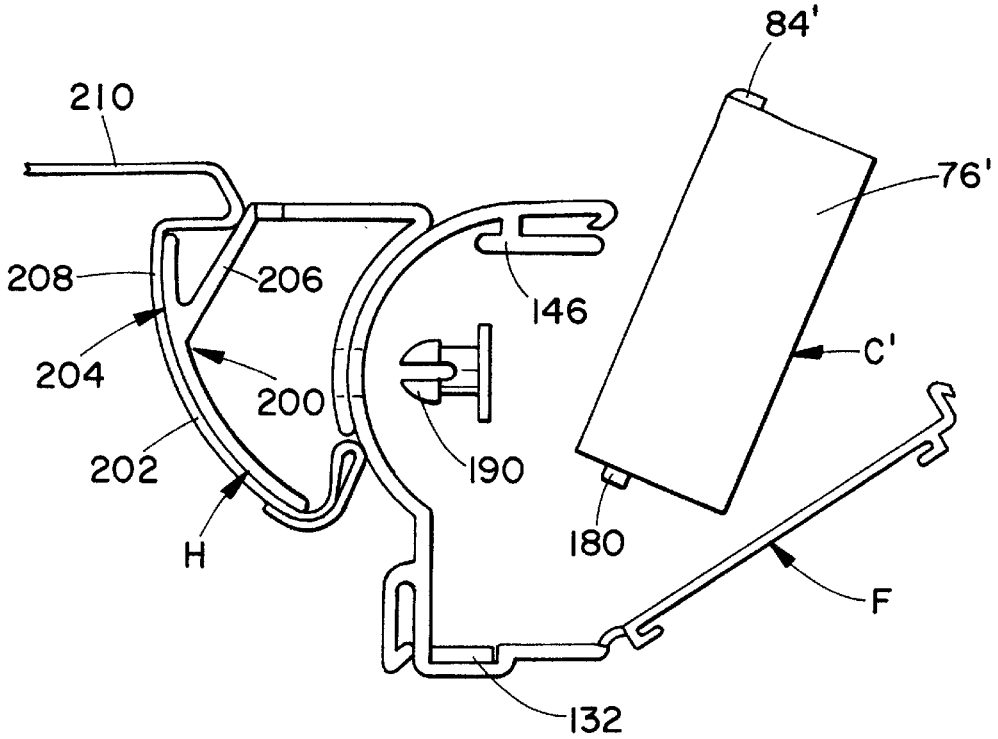
FIG. 6 is a reduced side elevational view of the holder employing the housing and adaptor of FIG. 5 in the process of being secured together.
Figure 7:
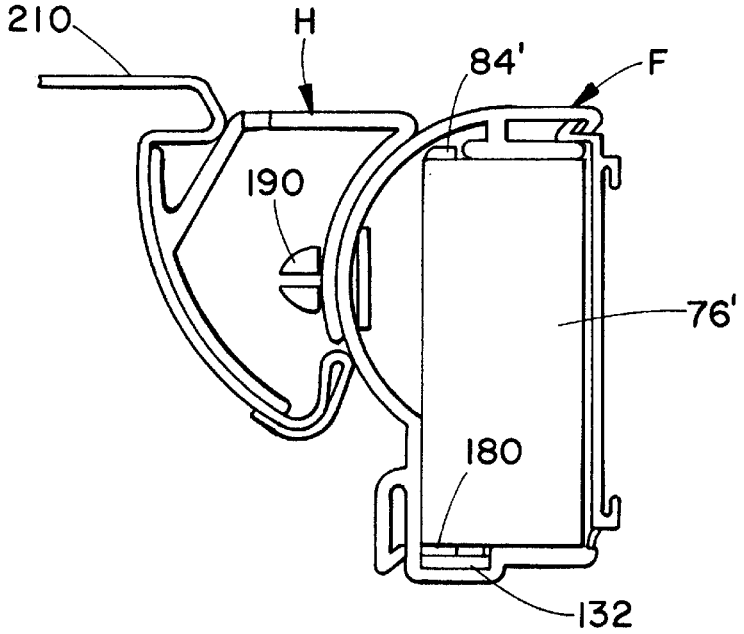
FIG. 7 is an assembled side elevational view of the holder of FIG. 6.

With reference now also to FIG. 6, an electronic price label C' is there illustrated as being secured in place in the housing F. To this end, a casing 76' includes a finger 84' which cooperates with the flange 146 of the housing F. The casing 76' also comprises a protrusion 180 which, when the price label is secured in the housing F as illustrated in FIG. 7, is cooperable with and extends into the layer of flexible material 132 to prevent a sideward sliding motion of the casing 76' in the housing.

To secure the housing F in an adaptor H, there is provided one or more fasteners 190, which may be dart clips. The adaptor H comprises an adaptor body 200 having a back wall 202 with a forked upper end 204. This comprises a first fork arm 206 which extends forwardly and a second fork arm 208 which extends rearwardly. It is noted that the two fork arms are of different lengths in contrast to the adaptor G illustrated in FIG. 5. The adaptor H allows the housing F to be secured to a suitable conventional shelf 210.

Figure 8A:
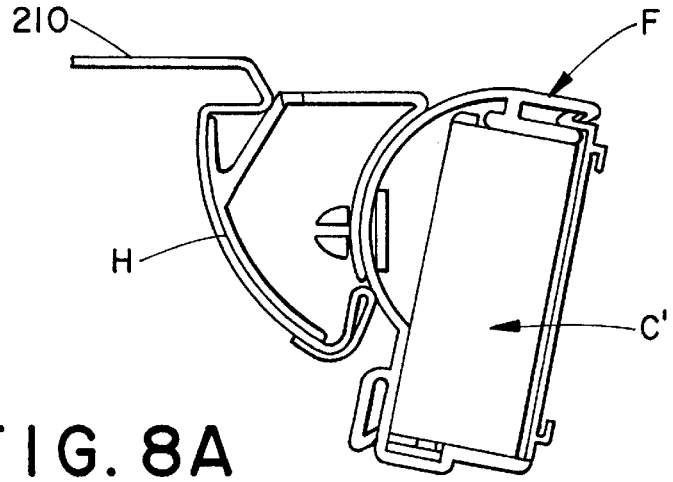
FIGS. 8A–8C are side elevational views illustrating the various angles at which the electronic price label of the holder of FIG. 7 can be displayed in relation to a shelf.
Figure 8B:
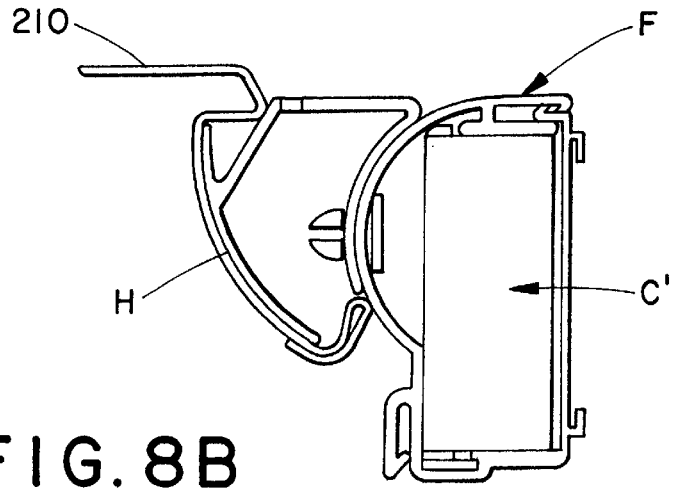
Figure 8C:
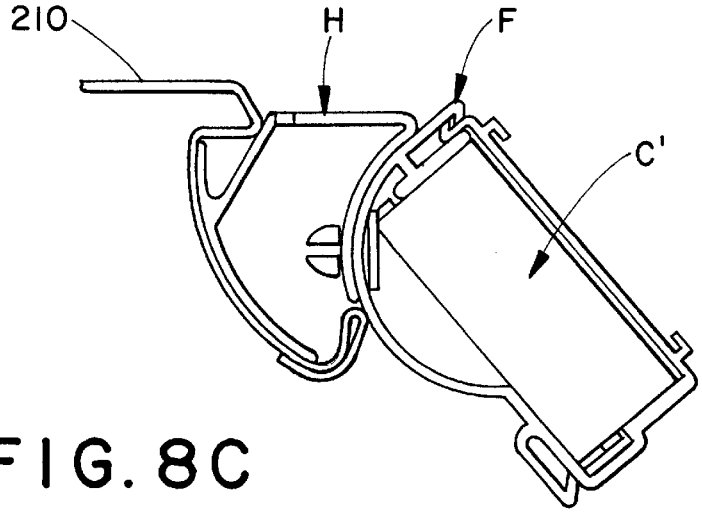

As illustrated in FIGS. 8A–8C, depending upon which sets of apertures are selected in the housing F and the adaptor H, the electronic price label C' can be oriented either at a 10° downwards angle, as illustrated in FIG. 8A, a 0° angle, as illustrated in FIG. 8B, or a 40° upwards angle as illustrated in FIG. 8C.

Figure 9:
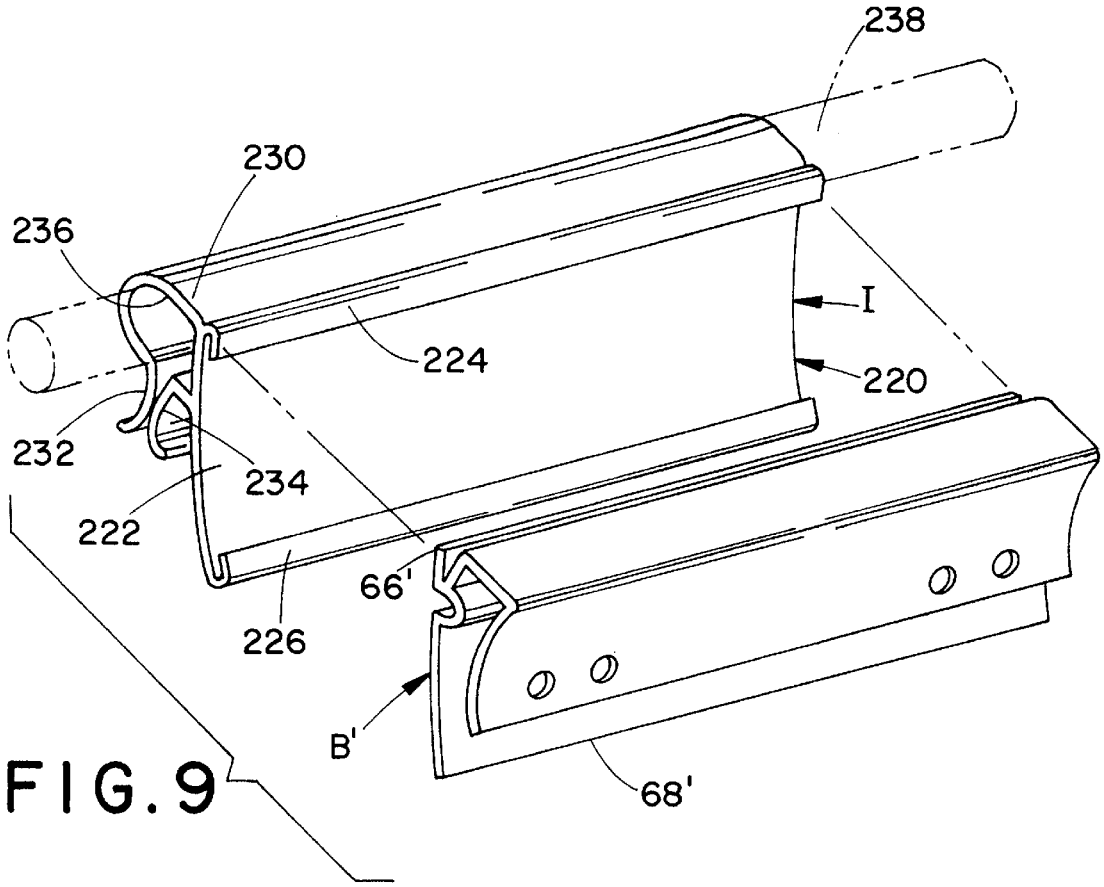
FIG. 9 is an exploded perspective view of an adaptor and a mount according to another embodiment of the present invention.

With reference now to FIG. 9, an adaptor B' is there illustrated as being secured in a mount I. The mount, which can be made from a suitable conventional thermoplastic, includes a plate 220 having a front wall 222 from which protrude an upper lip 224 and a lower lip 226. The upper and lower ends 66' and 68' of the adaptor B' are held by the lips 224 and 226. The mount I also comprises a clip 230 which is defined by first and second lips 232 and 234 that are located adjacent each other. The lips can be pried apart and resiliently enclose a longitudinally extending channel 236 which can accommodate a bar 238 of, e.g., a drawer or like wire framed article in which merchandise can be stored or accommodated. Therefore, the mount I enables the electronic price labels to be secured to merchandising fixtures other than shelving.

Figure 10A:
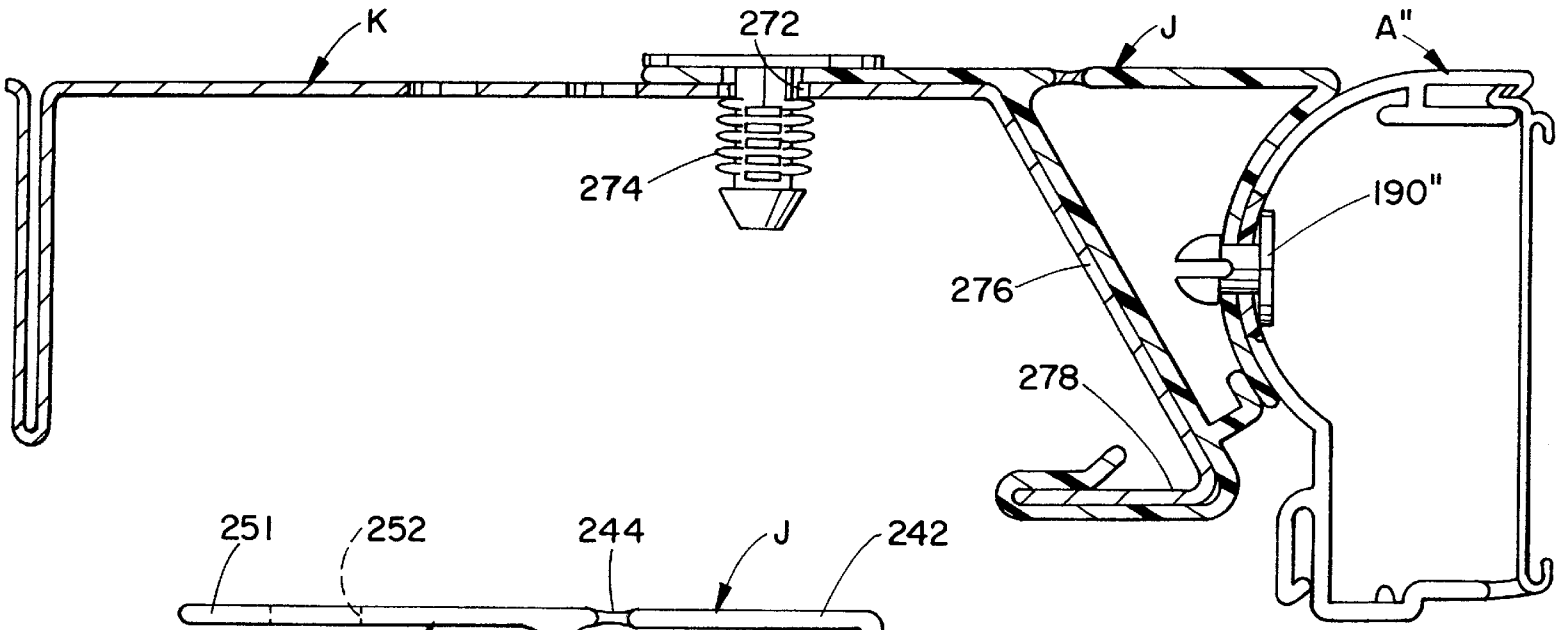
FIG. 10A is a side elevational view of a holder according to still another embodiment of the present invention.
Figure 10B:
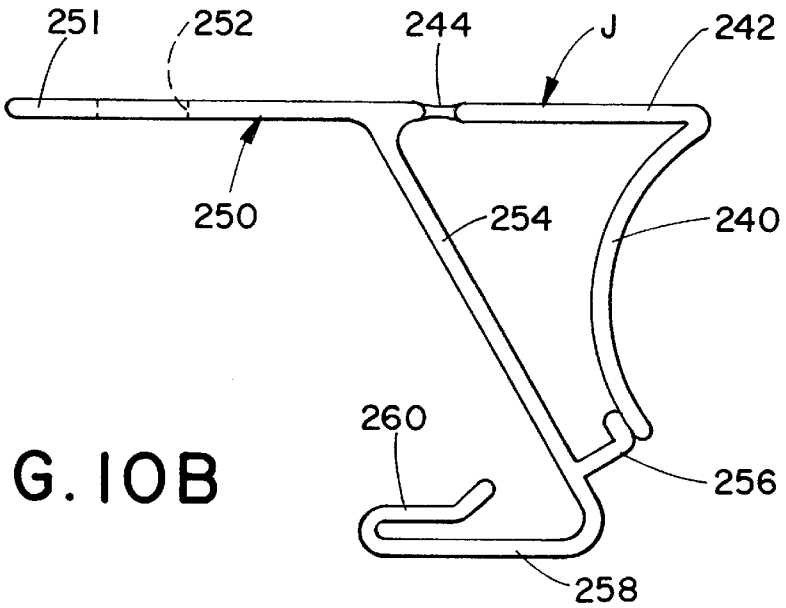
FIG. 10B is a side elevational view of an adaptor of the holder of FIG. 10A.

With reference now to FIG. 10B, an adaptor J meant for allowing a housing A" to be secured to a different type of shelf is there illustrated. More specifically, the adaptor J comprises a curved front wall 240, a planar top wall 242 and a hinge 244 which pivotally secures the front wall and the top wall to a rear wall 250. The rear wall includes an upper section 251 having a transverse aperture 252. Extending from the upper section is a side section 254. The side section has a forwardly extending flange 256. Disposed at the bottom edge of the side section is a bottom section 258. The bottom wall includes an upwardly extending lip 260.

With reference now to FIG. 10A, a shelf K to which the adaptor J can be secured includes an aperture 272 into which a suitable conventional fastener 274 can extend. It is evident that the fastener 274 extends through the aligned apertures 252 and 272 in order to secure the adaptor J to the shelf K. The shelf also comprises a side wall 276 which is overlaid by the side wall 254 of the adaptor J. In addition, the shelf has a bottom wall 278 which is overlaid by the bottom wall 258 and held by lip 260 of the adaptor J. It can be seen that the housing A" is secured to the adaptor J via suitable fasteners 190".

Depending upon which sets of apertures are selected in the housing A" and adaptor J, an electronic price label can be oriented either at a 0° angle, a 10° downwards angle, a 40° upwards angle, as shown in connection with FIGS. 8A–8C. It should be evident that by a suitable placement of the aligned apertures in the adaptor J and housing A", the precise degrees of orientation can be changed.

It is evident from FIG. 10A that the housing A" is higher than the height of the shelf K. One of the purposes for the hinge 244 on the adaptor J is to allow the housing A" to pivot upwardly out of the way to allow access by a customer to products held on the shelf below the electronic information carrier.

Figure 11:
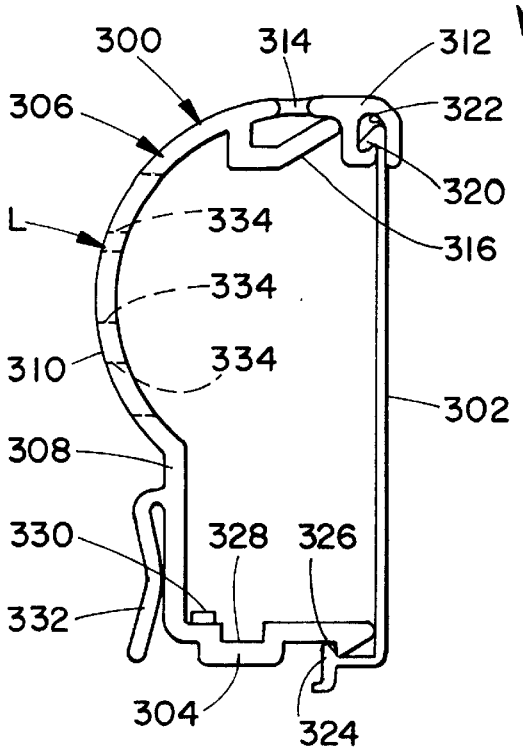
FIG. 11 is a side elevational view of a housing according to a second embodiment of the present invention.

With reference now to FIG. 11, a housing L according to a second preferred embodiment of the invention is there illustrated. This housing comprises a body 300 having a transparent front wall 302, a bottom wall 304 and a back wall 306 having a planar first section 308 and a convex second section 310. The back wall terminates in a top wall 312. The top wall is connected by a hinge 314 to the back wall 306. A finger 316 extending forwardly from a top end of the back wall 306 limits a clockwise rotation of the top wall 312 by contacting an inner surface of the top wall. However, the hinge enables the top wall 312 to rotate in a counterclockwise direction as shown by arrow 318 to a limited extent so as to allow the front wall 302 to become detached at its lower end from the bottom wall 304.

The front wall 302 is preferably made from a transparent material such as, e.g., a thermoplastic which could be clear PETG (polyethyleneterephthalate glycol). The housing body 300 is preferably made from a suitable conventional thermoplastic material such as PVC (polyvinyl chloride) via a conventional co-extrusion process since the hinge is made from a softer grade of PVC than is the remainder of the housing.

The front wall or window has an upper flange 320 which is accommodated in a channel 322 defined at the front end of the top wall 312. A lower flange 324 of the front wall 302 cooperates with a shoulder 326 defined on the bottom wall 304 of the housing. The upper flange 320 of the front wall is slid into the channel 322 of the top wall in order to connect the front wall to the remainder of the housing. This is accomplished in a position where the lower flange 324 is not in contact with the shoulder 326 of the bottom wall. Subsequently, the lower flange 324 can be snapped over the shoulder due to the resilience of the thermoplastic material from which both the front wall and the remainder of the housing are made.

Figure 12:
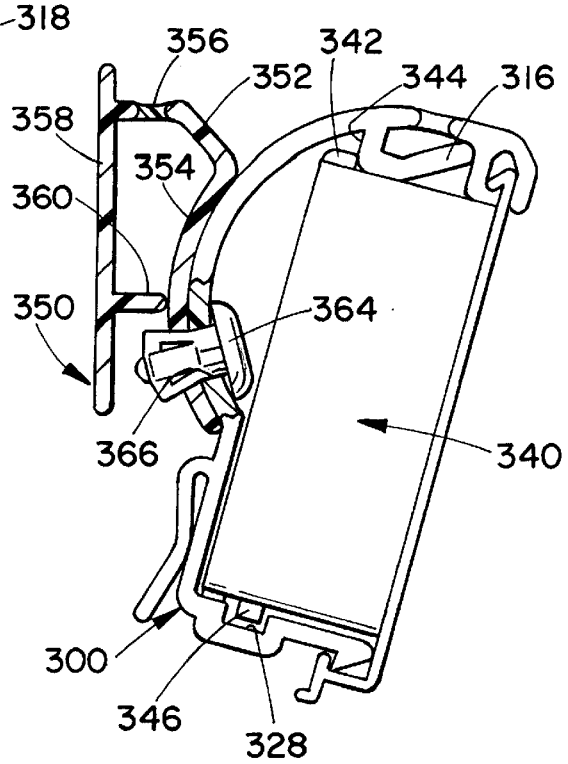
FIG. 12 is a side elevational view of the housing of FIG. 11 as mounted on a warehouse adaptor.

Defined in the bottom wall 304 is a groove 328 which extends longitudinally. Located adjacent the groove is a layer of a flexible material 330. Provided on a rear surface of the back wall first section 308 is a holding finger 332. A plurality of spaced apertures 334 extend through the convexly curved second section 310 of the back wall 306. By use of one of these apertures, the housing 300 can be adjusted to −15 degrees, +15 degrees and +45 degrees in relation to a horizontal plane for viewability of an electronic price label (EPL). Such an EPL is illustrated in FIG. 12 and identified by the numeral 340. The EPL includes a housing including a top wall having at least one arm with a protruding finger 342. The finger is accommodated behind the finger 316 extending downwardly from the upper end of the rear wall 306. The EPL 340 also includes a bottom wall from which a protrusion 344 extends. When the price label is secured in the housing 300, as illustrated in FIG. 12, the protrusion 344 extends into the groove 328 so that a back end of the bottom wall of the EPL 340 contacts the layer of flexible material 330 and is thereby prevented from sliding in the housing 300.

The front wall 302 is connected to the remainder of the housing 300 by sliding the upper flange 320 into the channel 322. These elements are separately manufactured and assembled together. Once the front wall or window 302 is secured to the housing by co-action of both flanges 320 and 324 with respective sections 322 and 326 of the top and bottom walls of the housing, the front wall no longer moves readily and this prevents dislodgement thereof.

With continuing reference to FIG. 12, the housing body 300 can be selectively secured to a warehouse adaptor 350. The adaptor includes a front wall 352 having a concavely curved section 354 which accommodates the convexly curved rear wall section 310 of the housing 300. The front wall is joined by a hinge 356 to a rear wall 358 of the adaptor. A rib 360 extends forwardly from the rear wall in spaced relationship to the hinge 356. If desired, a suitable adhesive layer (not illustrated) can be provided on a rear surface 362 of the rear wall. In this way, the adaptor 350 can be mounted either in a C-channel or on any desired vertical wall surface.

If desired, the warehouse adaptor 350 can be made from a suitable thermoplastic material, such as PVC, via a co-extrusion process. As may be evident, by employing different ones of the apertures 334 in the housing body 300 through which a conventional fastener 364 extends, the housing body 300 can be secured in a desired angular relationship in relation to the adaptor 350. The fastener 364 extends through a mating aperture 366 located in the curved section 354 of the front wall 352. In this way, the housing body 300, and hence the EPL 340, can be adjusted to −15 degrees, such as is illustrated, +15 degrees or +45 degrees in relation to a horizontal plane.

The hinge 356 allows the front wall 352 of the adaptor 350 to pivot counterclockwise in relation to the remainder of the adaptor in order to allow access to a rear end of the fastener 364 when it becomes necessary to remove the fastener so as to allow a disengagement of the housing body 300 from the adaptor 350. The rib 360 prevents a continued clockwise rotation of the front wall 352 around the hinge 356 once the rib engages a rear surface of the front wall. It should be recognized that in order to have access to the fastener 364, the housing front wall 302 needs to be rotated around hinge 316 so as to allow access to the EPL 340. Once the EPL is removed, then the head of the fastener 364 becomes accessible.

Figure 14:
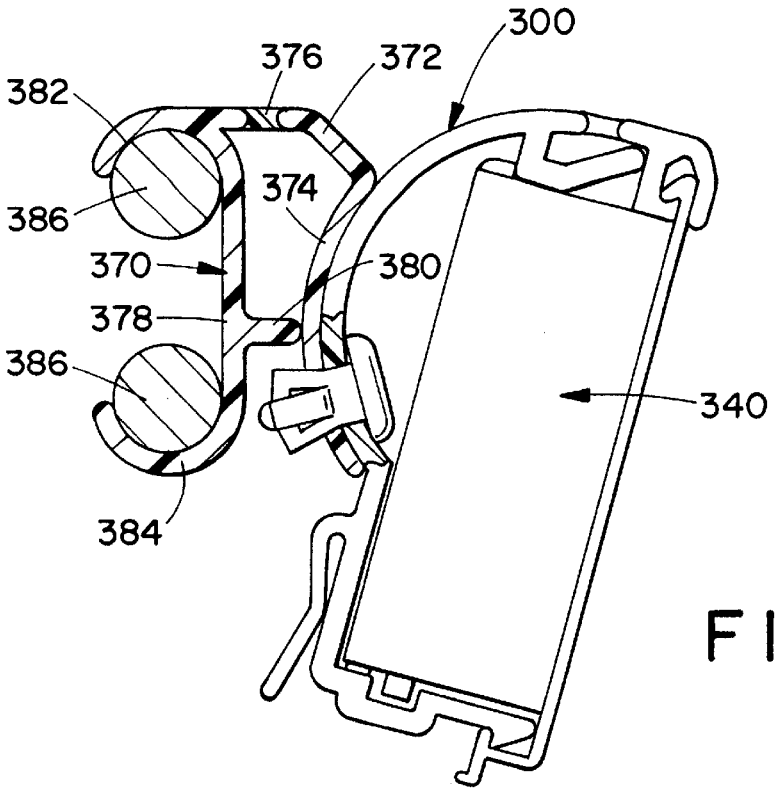
FIG. 14 is a side elevational of the housing of FIG. 11 as mounted on a wire fixture adaptor.

With reference now to FIG. 14, another type of adaptor 370 used for a wire fixture is there illustrated. This adaptor includes a front wall 372 having a concavely curved section 374 and a hinge 376 connecting the curved section to a rear wall 378. A rib 380 extends forwardly from the rear wall. The rear wall comprises top and bottom arms 382 and 384 which enable the adaptor 370 to be secured to a pair of spaced parallel rail members 386 of the wire fixture as is illustrated.

Figure 13:
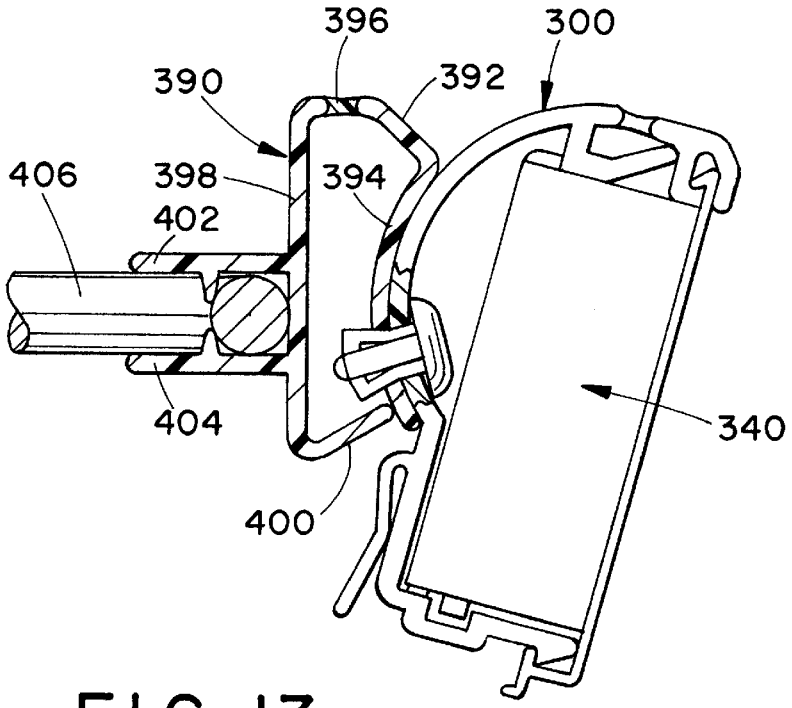
FIG. 13 is a side elevational view of the housing of FIG. 11 as mounted on an angled peghook adaptor.

With reference now to FIG. 13, an adaptor 390 is there illustrated which is useful for a conventional angled peghood. The adaptor 390 includes a front wall 392 having a concavely curved section 394 and a hinge 396 which connects the front wall to a rear wall 398. A rib 400 extends forwardly from a bottom end of the rear wall 398. Extending rearwardly from the rear wall 398 are a pair of arms 402 and 404 which enable the adaptor 390 to be snap fit onto an angled peghook 406.

Figure 15:
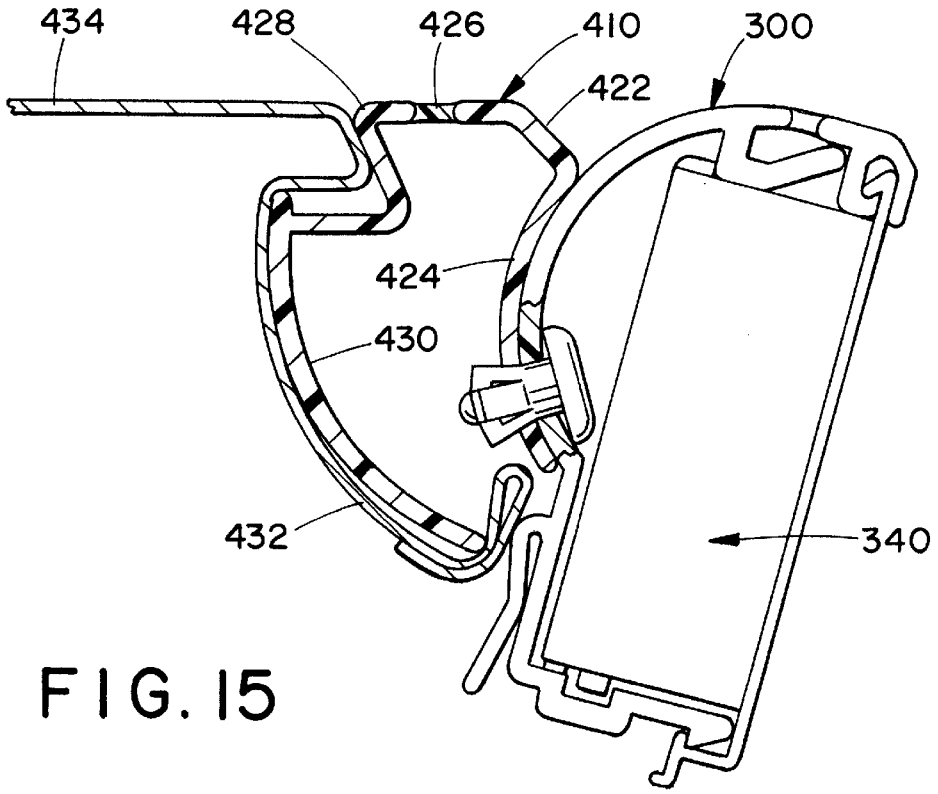
FIG. 15 is a side elevational view of the housing of FIG. 11 as mounted on a C-channel adaptor.

With reference now to FIG. 15, an adaptor 420, for a C-channel, is there illustrated. This adaptor includes a front wall 422 having a concavely curved section 424 accommodating the convexly curved rear surface of the housing. The front wall 422 is connected via a hinge 426 to a forwardly extending arm 428 of a rear wall 430.

It can be seen that the rear wall is somewhat curved in order to be accommodated in a conventional C-channel 432 formed along the front surface of a shelf 434. The adaptor rear wall 430 snaps into the channel and can be snapped out of it since the adaptor is made from a suitable conventional resilient thermoplastic material. It should also be recognized that the hinge 426 allows the front wall 422 of the adaptor to flip up for the purpose of enabling access to the rear wall 430 of the adaptor in order to both insert and remove the adaptor from the C-channel 432.

Figure 16:
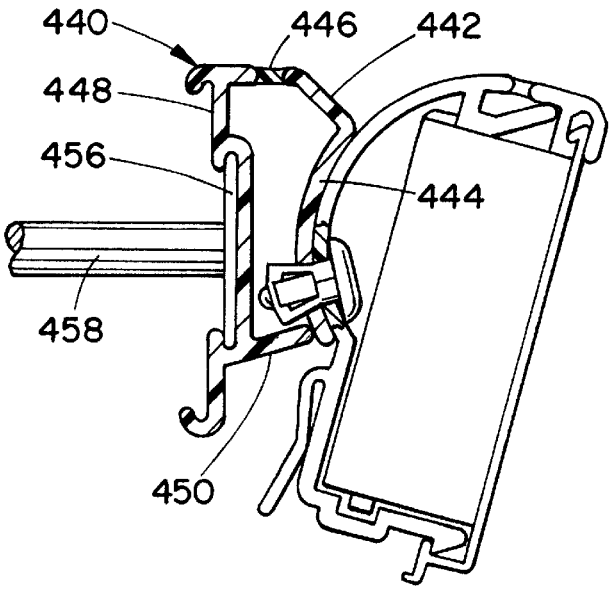
FIG. 16 is a side elevational view of the housing of FIG. 11 on a reduced scale as mounted on a peghook rail adaptor which is used on a peghook plate mount.
Figure 17:
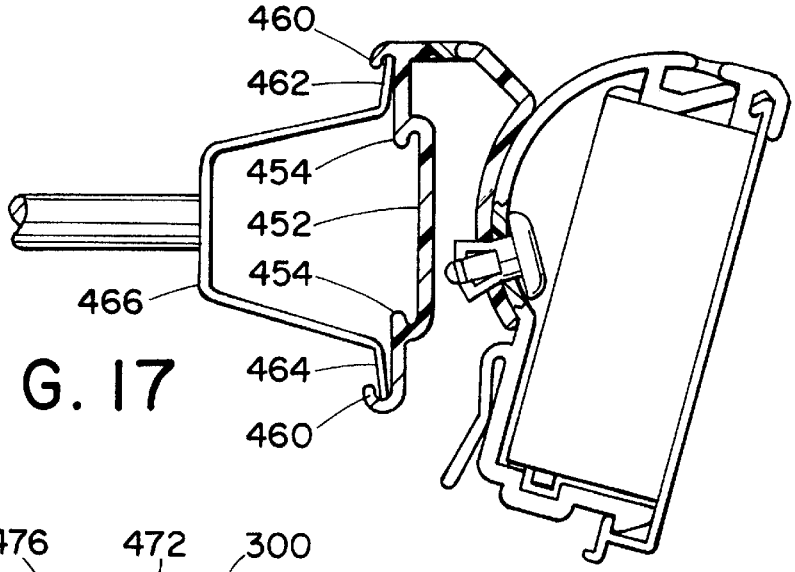
FIG. 17 is a side elevational view of the housing of FIG. 11 on a reduced scale as mounted on a peghook rail adaptor employing a spring clip mount.

With reference now to FIG. 16, a peghook rail adaptor 440 is there illustrated. This adaptor includes a front wall 442 having a curved section 444 and a hinge 446 which connects the front wall to a rear wall 448. A rib 450 extends forwardly from the rear wall and contacts a rear surface of the curved section 444. The rear wall includes an indented center section 452 (FIG. 17) which has defined on it a pair of spaced flanges 454 extending towards each other. The flanges are meant to accommodate a front plate 456 of a peghook 458 such as is illustrated in FIG. 17A. The rear wall 448 also includes a pair of upper and lower curved flanges 460. Each of the flanges is meant to accommodate a respective end 462 and 464 of a spring clip 466 secured to a peghook.

Figure 18:
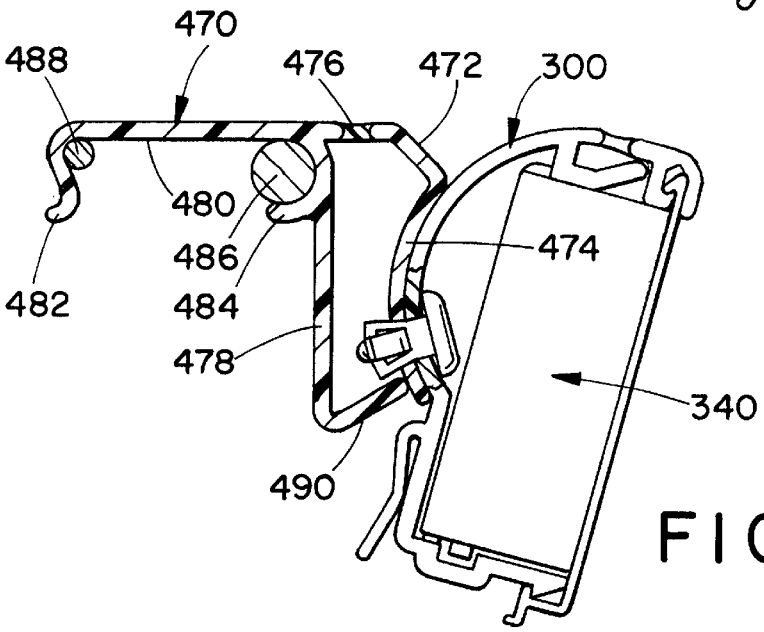
FIG. 18 is a side elevational view of the housing of FIG. 11 as mounted on a freezer clip adaptor.

With reference now to FIG. 18, a freezer clip adaptor 470 is there illustrated. This adaptor comprises a front wall 472 having a convexly curved section 474 and a hinge 476 which connects the front wall to a rear wall 478. Extending away from the rear wall is a rear leg 480 which terminates in a downwardly turned and inwardly extending free end 482. Extending rearwardly from the rear wall is a protrusion 484 which is spaced in relation to the top surface 480. The protrusion and a front end of the top surface or wall accommodate a first rail 486 of the freezer. The free end 482 of the adaptor 470 accommodates a second rail 488 of the freezer. Extending forwardly from a bottom end of the rear wall 478 is a flange 490 which selectively contacts a rear surface of the front wall curved section 474, depending on the rotational orientation of the front wall.

Figure 19:
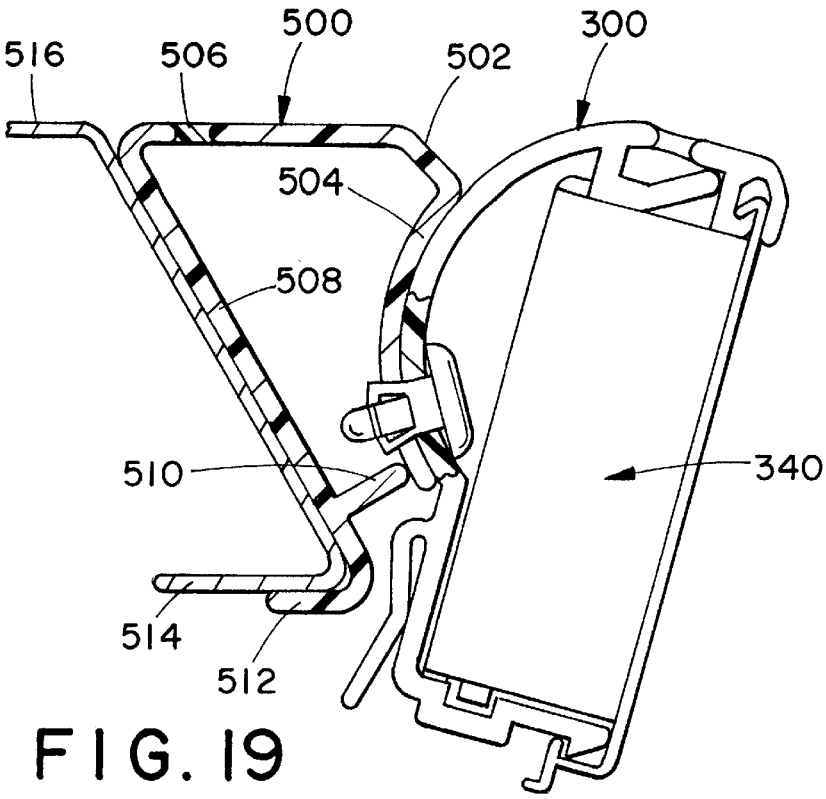
FIG. 19 is a side elevational view of the housing of FIG. 11 as mounted to an angled front plate adaptor.

With reference now to FIG. 19, an angled front plate adaptor 500 is there illustrated. This adaptor comprises a front wall 502 having a curved section 504 and a hinge 506 which connects the front wall to a rear wall 508. Extending forwardly from the rear wall is a protrusion 510 which contacts a rear surface of the curved section of the front wall. Protruding rearwardly from the rear wall at a lower end thereof is a flange 512. The flange extends beneath a lower surface 514 of a shelf 516. If desired, the top end of the rear wall is even with a top surface of the shelf 516.

Figure 20:
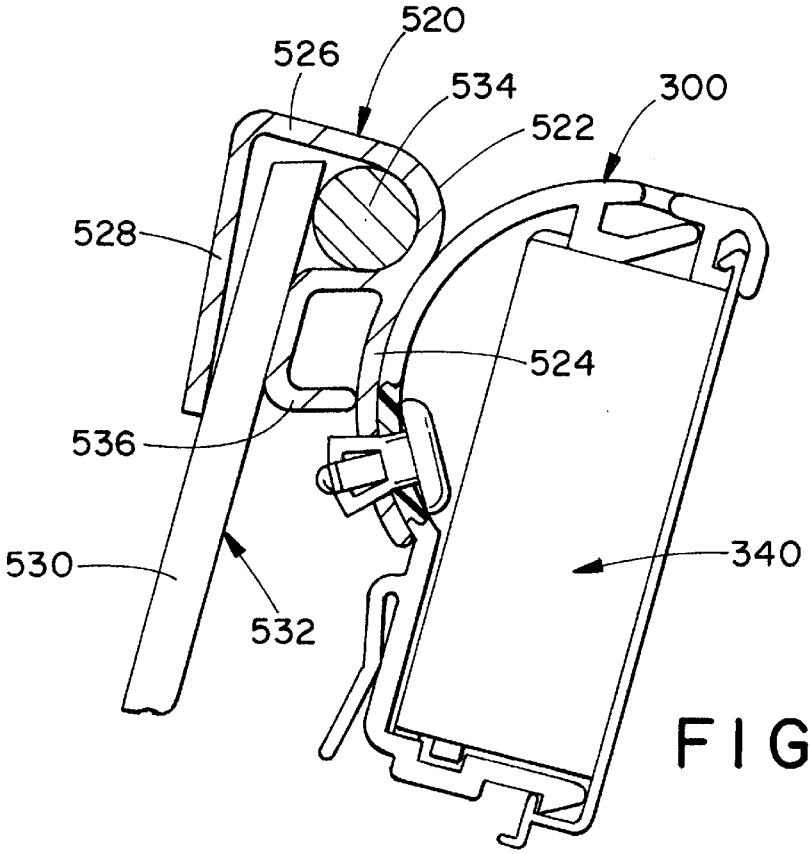
FIG. 20 is a side elevational view of the housing of FIG. 11 as mounted to a wire basket adaptor.

With reference now to FIG. 20, a wire basket-type adaptor 520 is there illustrated. This adaptor includes a front wall 522 having a curved section 524 which accommodates a curved rear surface of the housing 300 of the EPL 340. Connected to the front wall 522 is a top wall 526 and a rear wall 528 which extends downwardly onto a vertically extending member 530 of a wire basket 532. A horizontally extending rail 534 of the wire basket is accommodated between the front and rear walls of the adaptor above a rearwardly extending U-shaped leg 536. The leg extends rearwardly from the curved section 524 of the front wall. Since the wire basket adaptor is made from a suitable conventional resilient material, it can be flexed so as to allow the horizontal rail to pass into the cavity defined between the front and rear walls and around the leg 536.

Figure 21A:
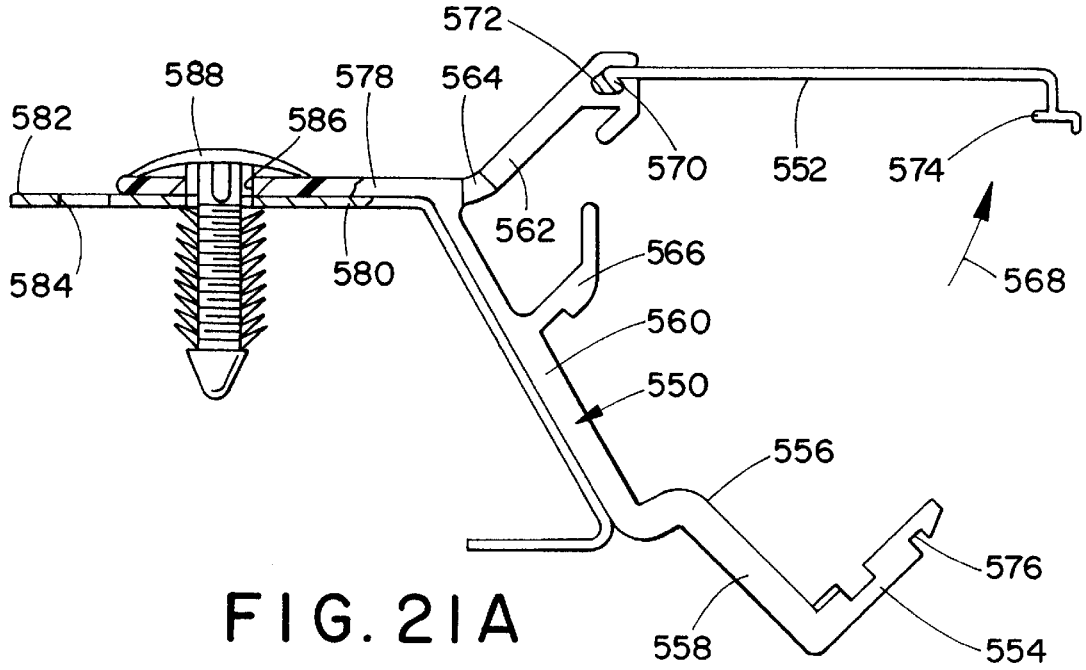
FIG. 21A is a side elevational view of an electronic price label housing for a bottom shelf with the housing being in an open position.

With reference now to FIG. 21A, a bottom shelf housing 550 is there illustrated. This housing includes a front wall 552, a bottom wall 554, a back wall 556 having a first section 558 and a second section 560, as well as a top wall 562. A hinge 564 connects the top wall to the back wall. Extending forwardly from the back wall is an arm 566. The hinge enables the front wall and the back wall to pivot in relation to the remaining two walls in the direction illustrated by arrow 568. The front wall includes an upper flange 570 which is accommodated in a channel 572 defined between a pair of arms at the front end of the top wall. The front wall also includes a lower flanged portion which is accommodated in a groove 576 defined in an outer surface of the bottom wall.

Figure 21B:
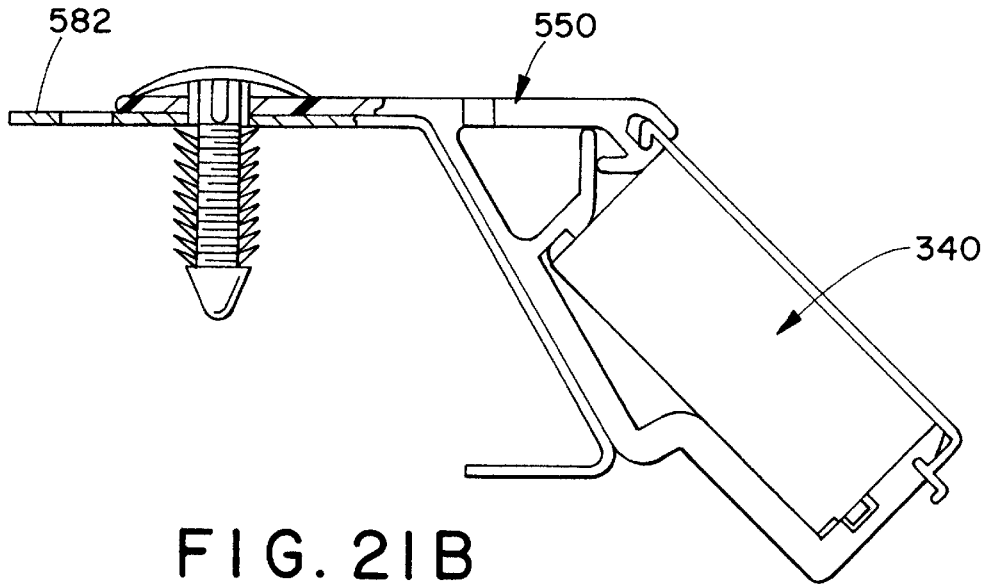
FIG. 21B is a side elevational view of the housing of FIG. 21A in a closed position with an electronic price label being held therein.

Extending rearwardly from the back wall 556 is an upper arm 578. The upper arm is meant to overlie an upper surface 580 of a shelf 582. The shelf has several suitable apertures 584 therein. One such aperture is aligned with a similar aperture 586 defined in the upper extension 578. A conventional fastener 588 can be pushed through the aligned apertures in order to secure the body 550 in place in relation to the shelf 582. As shown in FIG. 21B, in this alignment, the electronic price label 340 is tilted upwardly at a fixed 45 degree angle for viewability. Preferably, the body 550 is made from a suitable extrusion of PVC except that the front wall 552 thereof is made from a clear PETG type thermoplastic and slid into place on the body.

Figure 22:
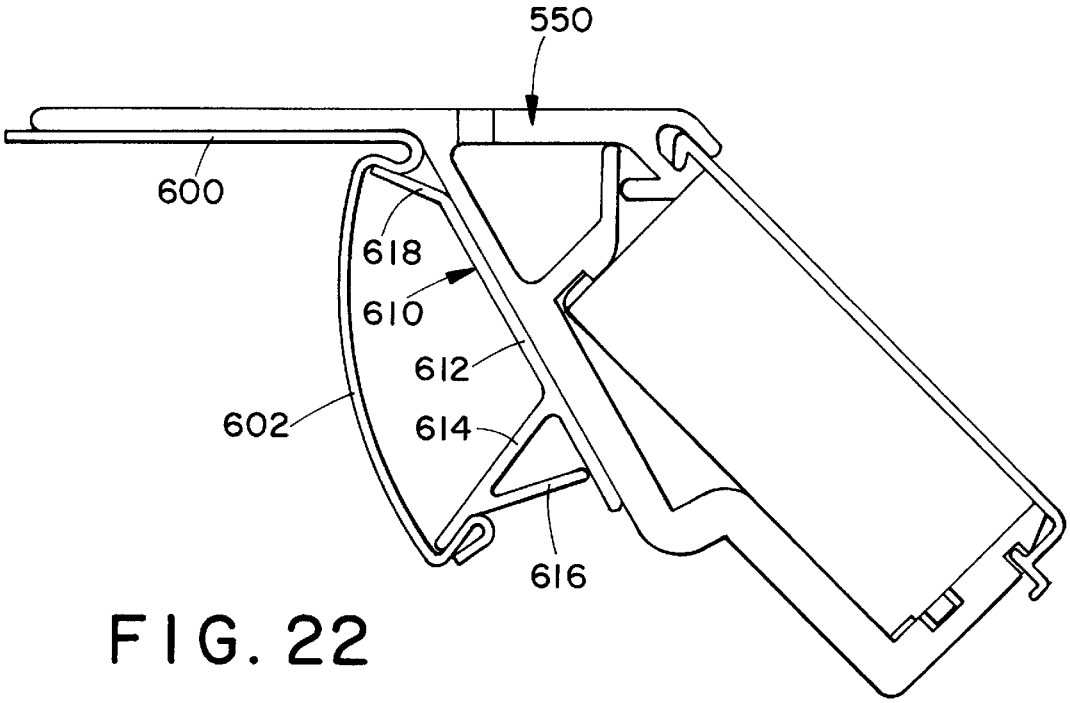
FIG. 22 is a side elevational view of the housing of FIG. 21A as used with a C-channel adaptor.

With reference now to FIG. 22, it should be appreciated that the bottom rail adaptor can be employed for use with shelves not having the flat front face shown in FIGS. 21A and 21B. One such shelf is illustrated by the numeral 600 in FIG. 22. The shelf includes a C-channel 602 extending along its front face. In order to adapt the body 550 for use in this environment, there is provided a bottom rail adaptor 610. The adaptor comprises a front wall 612. Extending rearwardly therefrom is a leg 614 accommodated in a lower end of the C-channel. Extending forwardly from the leg at an angle thereto is a rib 616. The rib limits the extent to which the leg can pivot in relation to the front wall. An upper end 618 of the front wall is angled in relation to the remainder thereof so as to be accommodated at the upper end of the C-channel. The rear end of the leg is accommodated at a lower end of the C-channel.

Figure 23:
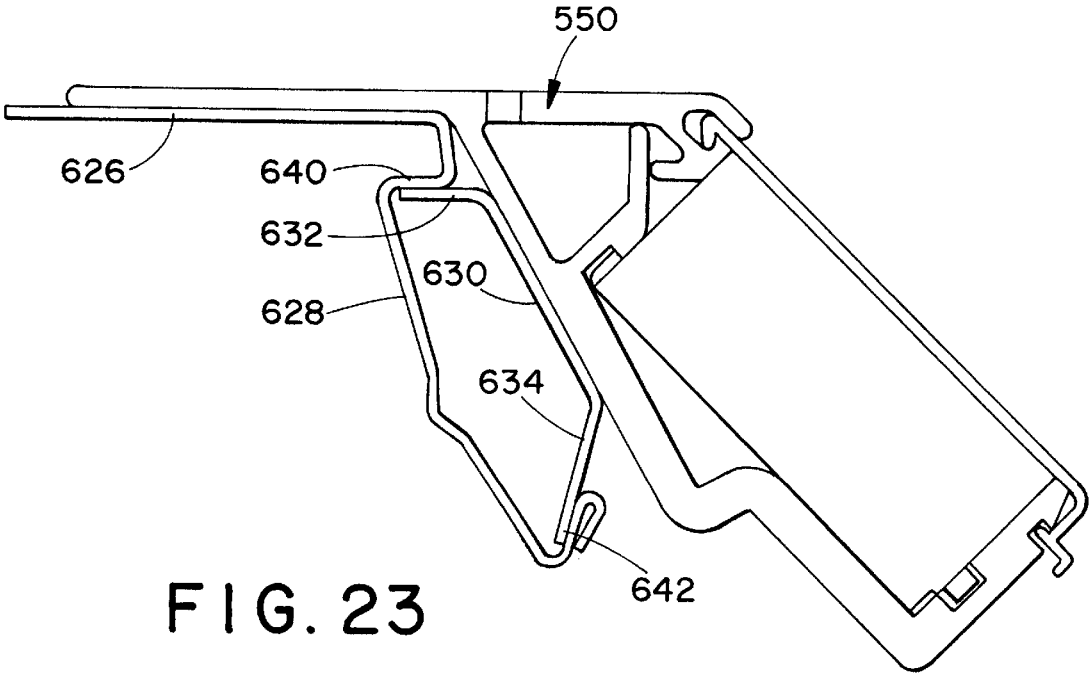
FIG. 23 is a side elevational view of the housing of FIG. 21B as used with another type of bottom rail adaptor; and, FIG. 24 is a side elevational view of a housing according to a third embodiment of the present invention.

With reference now to FIG. 23, a different type of rail adaptor for another type of rail 626 having a C-channel 628 therein is there illustrated. This adaptor 630 has a front wall and, extending rearwardly therefrom, upper and lower ends 632 and 634. The upper end is accommodated in an upper end 640 of the C-channel 628 defined along a front edge of the shelf 626. The lower end 634 is similarly accommodated in a lower end 642 of the channel 638.

Figure 24:
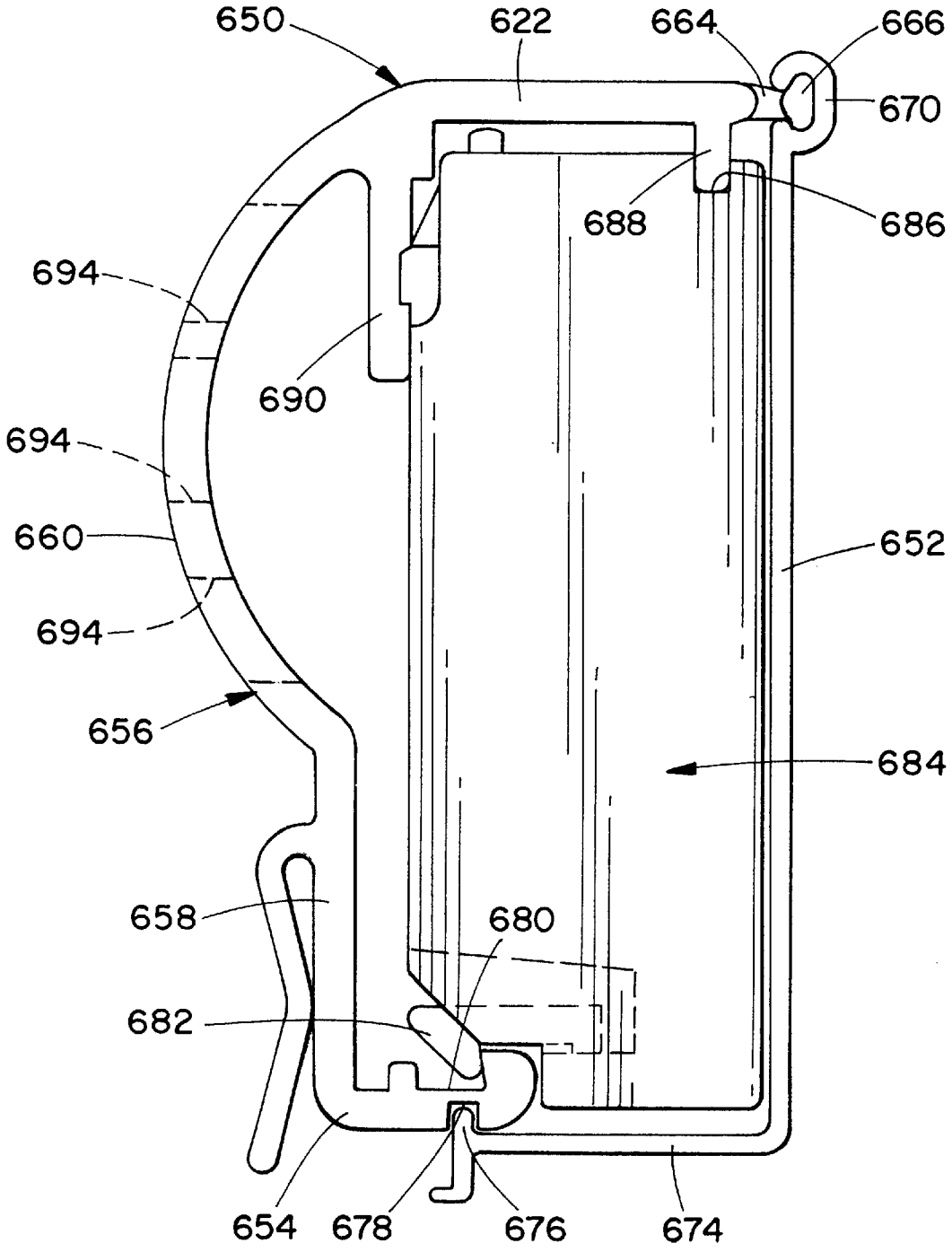

Finally, with reference now to FIG. 24, it should be appreciated that electronic price labels having a different configuration from that illustrated in, e.g. FIGS. 1 and 12, can also be employed. With a different type of electronic price label, a different upper and lower wall surface is necessary for the EPL housing. As shown, a housing body 650 includes a front wall 652, a bottom wall 654, a rear wall 656 having a first section 658 and a second section 660, as well as a top wall 662. A hinge 664 connects a front extension 666 with the remainder of the top wall. As in the other embodiments, the front wall 652 can pivot in relation to the remaining walls of the housing body around the hinge. The front wall has a U-shaped upper end 670 which accommodates the front extension. A lower end of the front wall includes a lengthy arm 674 having a flange 676 at a free end thereof. The flange 676 is accommodated in a groove 678 defined on an outer surface of the bottom wall 654. The bottom wall also has an inwardly defined groove 680 in which a finger 682 of an EPL 684 is accommodated. The EPL has defined therein an upper groove 686 which is meant to accommodate a downwardly extending rib 688 which is integral with the top wall 662 of the holder body. Also extending downwardly from the top wall in spaced relation to the rib 688 is an arm 690 which contacts a rear surface of the EPL. In this housing body 650, as in the embodiment illustrated, e.g., in FIG. 11, three spaced apertures 694 allow for the EPL 684 to be pivoted while held in the housing to −15 degrees, +15 degrees and +45 degrees to a horizontal plane.

The invention has been described with reference to several embodiments. Obviously, modifications and alterations will occur to others upon a reading and understanding of the specification. It is intended to include all such alterations and modifications as may fall within the scope of the appended claims or the equivalents thereof.

We claim:

1. A holder for an electronic information carrier, comprising:

a body comprising:

a cavity for holding an associated electronic price label, a transparent front window overlying said cavity;

a rear wall having a convex section, and an aperture extending through said convex section;

an adapter comprising:

a front wall having a concave section in which said rear wall convex section of said body can be accommodated, a rear wall, a hinge which connects said front wall of the adapter to said rear wall of the adapter, an aperture extending through said concave section, said adapter aperture being aligned with said body rear wall convex section aperture; and, a fastener which selectively extends through said aligned apertures to secure said holder to said adapter and orient said body at a first angle to a horizontal plane.

2. The holder of claim 1 further comprising:

at least one additional aperture extending through said body rear wall convex section, wherein said at least one additional aperture can be aligned with said adapter front wall concave section aperture to orient said body at a second angle in relation to the horizontal plane.

3. The holder of claim 1 wherein said front window comprises:

a first end including a flange for cooperating with a suitably shaped section of an exterior wall of said body to selectively secure said window in a locked condition on said body; and a second end including a means for pivotally mounting said window on said body.

4. The holder of claim 1 wherein said body comprises:

a first section cooperable with a first protrusion of the associated electronic price label to hold the associated electronic price label in said cavity; and, a second section cooperable with a second protrusion of the associated electronic price label to hold the associated electronic price label in said cavity.

5. The holder of claim 1 wherein said body further comprises a finger extending away from an external wall of said body, wherein an associated sign can be accommodated between said external wall and said finger.

6. The holder of claim 1 wherein said adapter further comprises a finger extending forwardly from said rear wall and selectively contacting said front wall, said finger being spaced from said hinge.

7. The holder of claim 1 wherein said adapter further comprises a locking means for selectively securing said adaptor to an associated support structure.

8. A holder for an electronic information carrier, which can be mounted on a front edge of a shelf or to a basket or other type of goods display compartment, the holder comprising:

a body which is approximately rectangular in cross section and which comprises:

a top wall, a bottom wall, a rear wall which connects said top wall to said bottom wall, a cavity defined between said walls for holding an associated electronic price label, a convex section defined on said rear wall, and an aperture extending through said convex section;

an adapter comprising:

a front wall having a concave section in which said rear wall convex section of said body can be accommodated, a rear wall, a hinge which connects said front wall of the adapter to said rear wall of the adapter, an aperture extending through said concave section, said adapter aperture being aligned with said body rear wall convex section aperture; and, a fastener which selectively extends through said aligned apertures to secure said holder to said adapter and orient said body at a first angle to a horizontal plane.

9. The holder of claim 8 further comprising:

at least one additional aperture extending through said body rear wall convex section, wherein said at least one additional aperture can be aligned with said adaptor front wall concave section aperture to orient said body at a second angle in relation to the horizontal plane.

10. The holder of claim 8 wherein said body further comprises a transparent front window overlying said cavity wherein said front window comprises:

a first end including a flange for cooperating with a suitably shaped section of an exterior wall of said body to selectively secure said window in a locked condition on said body; and, a second end including a means for pivotally mounting said window on said body.

11. The holder of claim 8 wherein said body comprises:

a first section cooperable with a first protrusion of the associated electronic price label to hold the associated electronic price label in said cavity; and, a second section cooperable with a second protrusion of the associated electronic price label to hold the associated electronic price label in said cavity.

12. The holder of claim 8 wherein said body further comprises a finger extending away from an external wall of said body, wherein an associated sign can be accommodated between said external wall and said finger.

13. The holder of claim 8 wherein said adapter further comprises a locking means for selectively securing said adapter to an associated support structure.

* * * * *